United States Patent [19]

Fishgal

[11] 4,271,929

[45] Jun. 9, 1981

[54] MACHINE LUBRICATION SYSTEM

[76] Inventor: Semyon I. Fishgal, 610-60 Mountainview Ave., Toronto, Ont. M6P 2L4, Canada

[21] Appl. No.: 12,592

[22] Filed: Feb. 16, 1979

[51] Int. Cl.[3] ..... F01M 1/10

[52] U.S. Cl. ..... 184/6.24; 210/166; 210/388; 210/510; 210/DIG. 22; 210/634

[58] Field of Search ..... 210/DIG. 22, 510, 19, 210/168, 388; 184/6.24, 6.25

[56] References Cited

U.S. PATENT DOCUMENTS

| | | | |
|---|---|---|---|
| 2,430,097 | 11/1947 | Bauer | 210/168 X |
| 2,441,681 | 5/1948 | Werder | 184/6.24 |
| 2,565,159 | 8/1951 | Williams | 210/DIG. 22 |
| 3,305,481 | 2/1967 | Peterson | 210/19 |
| 3,400,785 | 9/1968 | Allen | 210/168 X |
| 3,463,321 | 8/1969 | Van Ingen | 210/388 |
| 3,594,115 | 7/1971 | Wesley et al. | 210/19 X |

*Primary Examiner*—David H. Brown

[57] ABSTRACT

A machine lubrication system including an oil-lubricant pressure source communicated with a reservoir means and a means for maintaining the working properties of the lubricant, wherein the latter means constitutes a porous piezoelectric ceramic filtering element, such as barium titanate, connected to a generator of electric oscillations and placed into a housing which inlet and outlet are separated by said element.

1 Claim, 1 Drawing Figure

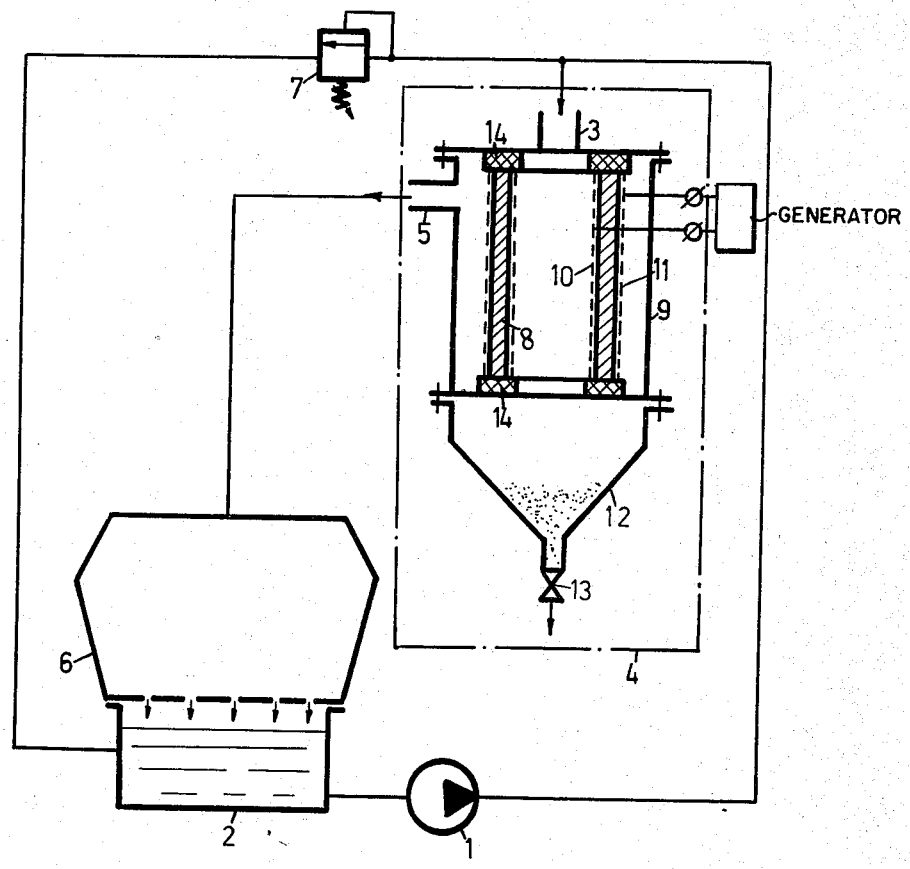
7
14
3
GENERATOR
5
10
11
9
8
14
12
13
6
4
2
1

MACHINE LUBRICATION SYSTEM

BACKGROUND OF THE INVENTION

This invention relates to machine lubrication systems of engines, compressors and the like machinery, including an oil-lubricant pressure source communicated with a reservoir means and a means for maintaining the working properties of the lubricant.

The latter means in known such systems (Charles Fayette Taylor, The Internal Combustion Engine in Theory and Practice, The MIT Press, Cambridge, Mass., 1966; K. Abrosimov, A. Bromberg, F. Katayev. Road-Making Machinery, Mir Publishers, Moscow, 1972; M. Khovakh. Motor-Vehicle Engines, Mir Publishers, 1971; B. Gelman and M. Moskvin. Farm Tractors, Mir Publishers, 1975; U.S. Pat. Nos. 3,400,285, 3,356,182, etc.) removes solid contaminants from lubricant by filtering, straining, gravitational displacement, centrifugal separation, etc. with full-flow and bypass (5–20% of the flow).

Being unable to remove all contaminants from lubricant, said removing means are assumed to be qualified if the size of the removed solids is more than the clearance in the sliding pairs of the machinery. In many cases this is achieved by fine-mesh bypass filters consuming much energy and requiring their frequent changes because of their clogging and, in some areas, becoming a repository for biological growth.

SUMMARY OF THE INVENTION

The objective of this invention is to relieve the requirements to filtration not only without increasing harmful effects of contaminants, but with improving the working properties of both the lubricants and the machinery. The most impressive economical effect is achieved in internal combustion engine applications.

Above objective is attained thanks to that said means for maintaining the working properties of lubricant constitutes a porous piezoelectric ceramic filtering element, such as barium titanate, connected to a generator of electric oscillations and placed into a housing which inlet and outlet are separated by said element.

Thus, besides a filter, the latter represents also an (ultra)sonic transducer eliminating clogging, allowing the significant increase of the size of the calibrating channels, breaking down contaminants to a non-interfering particle size (less than said clearance) and dispersing them in the lubricant.

The dispersed particles (in most common case less than 5 mkm)

(1) improve the antifrictional properties of the rubbing components (and therefore, the mileage of engines) by means of filling the cavities of the worn or defective surfaces, smoothing and restoring the latters, extending the actual contact area, increasing heat transfer between the surfaces, reducing pressure between them and the influence of microsiezure and other undesirable frictional effects;

(2) decrease the electrostatic component of wear as the particles absorb the products of oil oxidation and increase the electric conductivity of the oil lubricant;

(3) add the fire safety as electrostatic electricity accumulation is decreased for the above reasons;

(4) improve oil quality in response to silent discharges between metallic particles;

(5) improve the factors of acidity (characterizing the degree of oil oxidation) and alkalinity (characterizing undepleted additives) on 20–50%;

(6) decrease sliming on 15–30%;

(7) increase the time between oil changes at least by 2 times;

(8) decrease the deposition of carbon and varnish.

Thus, the present invention not only diminishes as it is too rigid requirements to filtration, but improves the system as a whole, increases its longevity and improves the antifrictional properties of rubbing components.

This performance far exceeds that of conventional filter systems (e.g. bypass filters) which this invention replaces.

Tests provided by independent researchers showed at least 50% oil reduction, savings in maintenance, filter changes and vehicle down time. $125 savings on initial cost of a truck and $232 per truck per year in oil changes have been indicated for "International Harvester" trucks with Cummins diesel engines, the data based on 150,000 miles per year and oil changes at 30,000 miles, instead of 15,000 miles normally used, although the oil could be changed after 40,000 miles or even more.

Therefore, the present invention would have considerable effect on the country's economy and her balance of payments.

BRIEF DESCRIPTION OF THE DRAWING

The FIGURE is a schematic representation of a machine lubrication system constructed in accordance with this invention.

DESCRIPTION OF THE PREFERRED EMBODIMENT

The machine lubrication system of the present invention includes a lubricant pressure source 1, e.g. a pump, which inlet communicates with a reservoir means 2 (such as a tank or sump), and which outlet communicates with the inlet 3 of a means 4 for maintaining the working properties of oil lubricant. The outlet 5 of the means 4 is connected to a machine 6, for example, an engine.

In FIGURE, in way of illustration, but not in a limiting sense, the reservoir means 2 is shown as a sump positioned in the conventional manner, so that lubricant, after performing its lubricating function within the machine 6, may drain into the sump.

A conventional coarse full-flow filter can be also used in the system (not shown) along with the means 4 for maintaining the working properties of lubricant.

The system is provided with a bypass line interconnected the means 4 with the reservoir 2 by means of a variable pressure bypass valve 7.

The means 4 for maintaining the working properties of lubricant constitutes a porous piesoelectric ceramic filtering element 8, such as barium titanate, placed into a housing 9 which inlet 3 and outlet 5 are separated by the element 8.

The latter is shaped as a hollow cylinder with its lateral surfaces 10 and 11 coated with a metallic conductor, e.g. silver. The metallized surfaces 10 and 11 are connected to a generator of electric oscillations (not shown).

The housing 9 is provided with a sediment bowl 12 and a valve 13.

Germetization of the element 8 in the housing 9 is achieved with sealings 14.

During operation, lubricant is pumped from the reservoir 2 through the means 4 (the inlet 3-the housing 9-the outlet 5) into the machine 6 wherein it performs lubrication and then drains into the reservoir 2. The excess lubricant proceeds through the relief valve 7 into the reservoir 2. The pressure setting of of the valve 7 corresponds to the required pressure.

The means 4 for maintaining the working properties of lubricant performs several functions.

As any filter does, it separates foreign matter from the lubricant entering the machine 6. Being also an (ultra)-sonic transducer, the filtering element 8 is not clogged because of an acoustic barrier near the vibrating surfaces. At working frequencies above 25 kilocycles, the coagulating action of ultrasonics settles down the contaminants into the sediment bowl 12, from which they are periodically removed through the valve 13. The transducer also breaks down solid contaminants by means of mechanical impacts and cavitation, dispersing the small particles into lubricant.

The physical changes induced by intense ultrasonic radiation are caused by heat, cavitation, steady ultrasonic forces (weak, however, compared with the cavitation forces) and large mechanical stresses (due to cavitation and ultrasonic waves).

The solids suspended in oil scatter some of the incidental radiation, thereby giving rise to an energy density gradient across themselves. If the solids are smaller than a wavelength, the resulting radiation pressure is small (unless they are in a standing wave system and tend to accumulate there in bands situated half a wavelength apart).

Besides an alternating wave force, the solids are subjected to a steady force arising since the viscosity of liquid does not remain constant over a pressure cycle with temperature variations.

The motion of the particles depends on their size and mass (larger particles oscillate with a smaller amplitude). The amplitude difference also increases probability of mutual collision of the solids.

The element 8 can work in cavitation regime. During collapsing the cavities, liquid particles move to the bubble center with a great speed. As a result, their kinetic energy causes local hydraulic impacts accompanied by high temperature and pressure. The contaminants are the nuclei of cavitation, the pressure pulses generated right where needed for the breaking down. Therefore, the energy is transferred directly to the contaminants and a minimum effective pressure is lost by divergence of energy. The required one is relatively modest, but concentrated over a small area and produces very high local stresses.

It is precisely the dispersion effect of the element 8 that allows to achieve the main effects mentioned in the Summary of the Invention, especially 2–3 times longer life of oil lubricants.

It is obvious that many modifications and adaptations can be made without departing from the spirit and scope of the invention.

I claim:

1. A machine lubrication system including an oil-lubricant pressure source communicated with a reservoir means and a porous piezoelectric ceramic ultrasonic transducer located in the flow path of the lubricant in a housing and partioning the latter into an input part and an output part.

* * * * *